United States Patent [19]

Green et al.

[11] Patent Number: 4,830,368

[45] Date of Patent: May 16, 1989

[54] ENERGY ABSORBING, ROTATABLE, REALIGNABLE, STATIONARY BASE

[76] Inventors: Paul G. Green, P.O. Box 2025, Coolidge, Ariz. 85228; Gregory C. Gayne, 4929 W. Hatcher, Glendale, Ariz. 85302

[21] Appl. No.: 723,480

[22] Filed: Apr. 15, 1985

[51] Int. Cl.[4] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 1,244,044 | 10/1917 | Falconer, Sr. | 273/24 |
| 2,298,689 | 10/1942 | Ferris | 273/25 |
| 3,204,958 | 9/1965 | Valasquez | 273/25 |
| 3,466,039 | 9/1969 | Golomb | 273/24 |

*Primary Examiner*—Richard C. Pinkham
*Assistant Examiner*—T. Brown

[57] ABSTRACT

An energy absorbing rotatable base for baseball and softball. An anchor post is fixed to the under side of a top plate. Four equally spaced steel bearing balls are also fixed to the underside of the top plate. A bottom plate has a central opening rotatably disposed over the anchor post. Four holes in the bottom plate are aligned with the four balls. A spring biasses the bottom plate toward the top plate. The bearing balls permit the bottom plate to rotate relative to the top plate and anchor post, and the balls and holes index the rotational position. Layers of foam padding are secured to the bottom plate and enclose the base assembly.

7 Claims, 9 Drawing Sheets

ENERGY ABSORBING, ROTATABLE, REALIGNABLE, STATIONARY BASE

FIELD OF THE INVENTION

This invention was conceived and designed as an item of athletic safety equipment. This invention relates to those bases known as first base, second base and third base in the sports of baseball and softball. This invention has for its purpose to provide a safe, non-rigid, yielding base to substantially eliminate those foot, ankle, knee and leg injuries and fractures resulting from improper sliding by the baserunner.

BRIEF DESCRIPTION OF THE DRAWINGS

FIGS. 14 and 15 are less dense closed cell energy absorbing material, and are known as the inserts U. These two inch thick inserts U are fitted into the appropriate cavities of one inch thick second layer N and one inch thick third layer Q when the second layer N and the third layer Q are cemented together.

DETAILED DESCRIPTION OF THE DISCLOSURE

This invention was conceived, designed, engineered and produced with the primary purpose of being a safe base for use in the sports of baseball and softball. To this purpose this invention is completely foam enclosed using a quality energy absorbing compression diffusion/deflection closed cell polyurethane material. The sheet metal used for the rotating mechanism is 16 gauge black iron. The center post I is Schedule 40 ¾" steel rod. Non-coated ⅜" steel balls G are used also.

Figure 1:
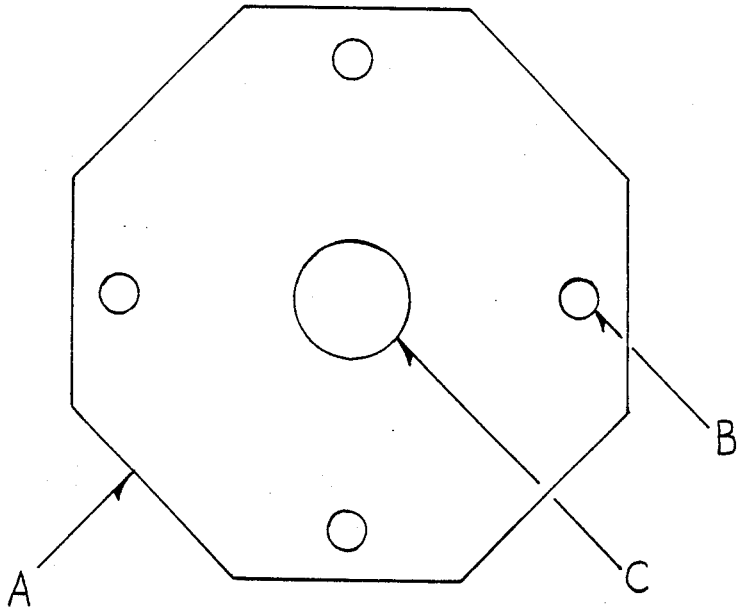
FIG. 1 is the smaller, upper octagonal shaped metal plate known as the ball locator plate. The ball locator plate A has one larger center hole C and four smaller holes B at 90 degree angles to each other.
Figure 3:
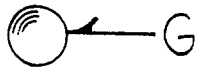
FIG. 3 is a view of a ⅜" diameter non-coated steel ball known as a locator ball G.
Figure 2:
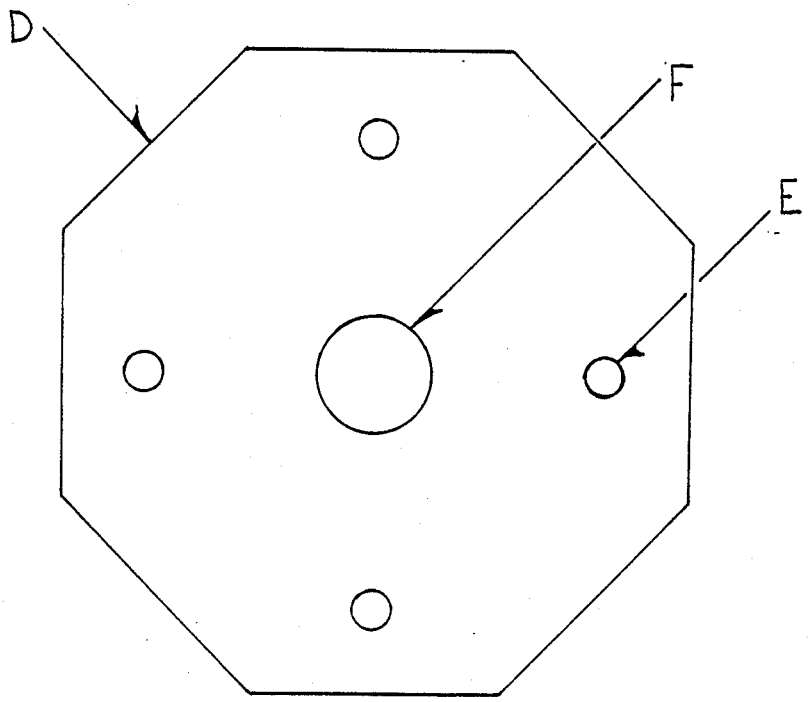
FIG. 2 is the larger, lower octagonal shaped, metal plate known as the paddle base plate. The paddle base plate D has one larger center hole F and four smaller holes E at 90 degree angles to each other.
Figure 4:
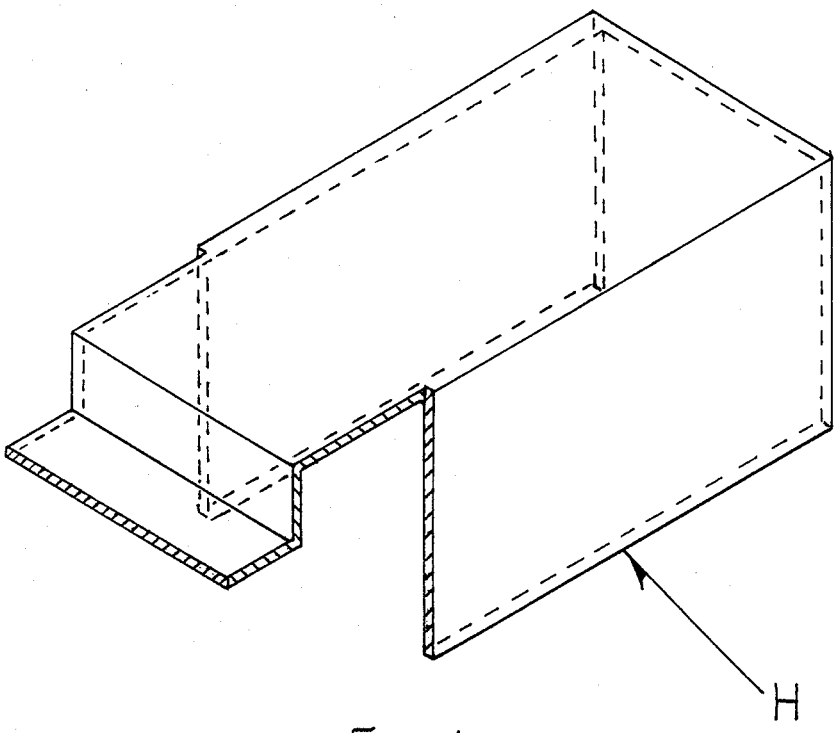
FIG. 4 known as the rotate paddle H. Four rotate paddles H are spot welded onto the paddle base plate D at the four chords between the holes for the locator balls G.
Figure 6:
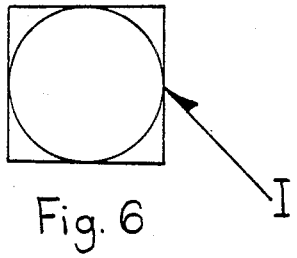
FIGS. 5 and 6 are known as the center post I. The center post I is welded to the ball locator plate A at the center hole C of the ball locator plate A. The center post I passes freely through the larger center hole F of the paddle base plate D.
Figure 7:
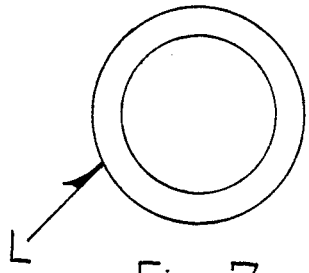
FIG. 7 is known as the tension spring holder washer L.
Figure 5:
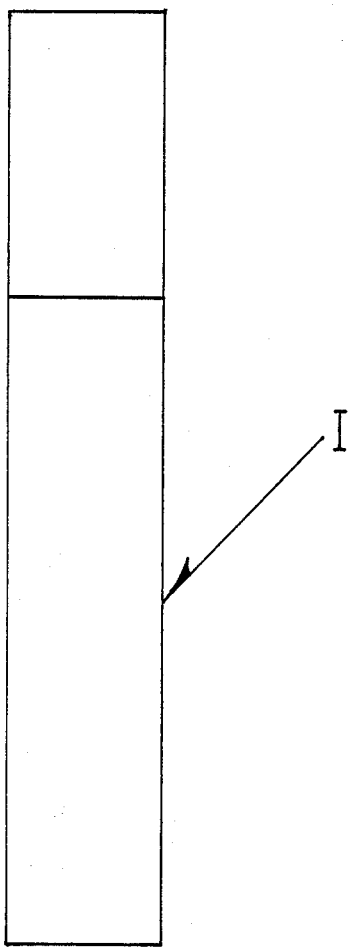
Figure 8:
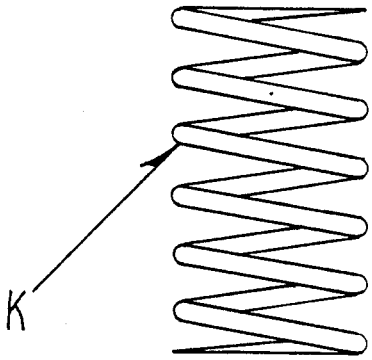
FIG. 8 is known as the tension spring K. The tension spring holder washer L is positioned on and welded to the center post I so as to provide a base for the tension spring K also positioned on the center post I between the tension spring holder washer L and the underside of the paddle base plate D.
Figures 9, 10:
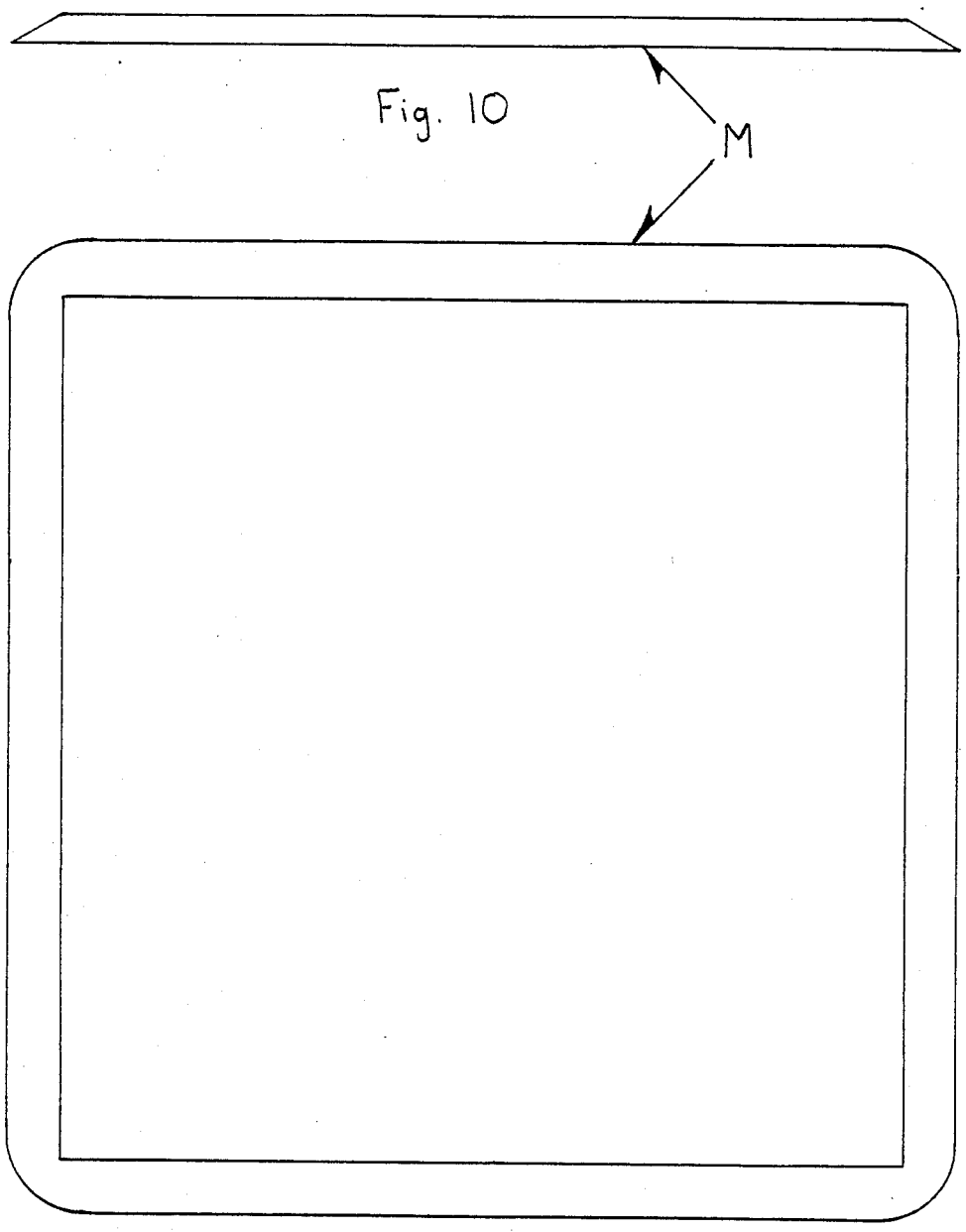
FIGS. 9 and 10 are the top layer of energy absorbing material and are known as the top layer M.
Figure 11:
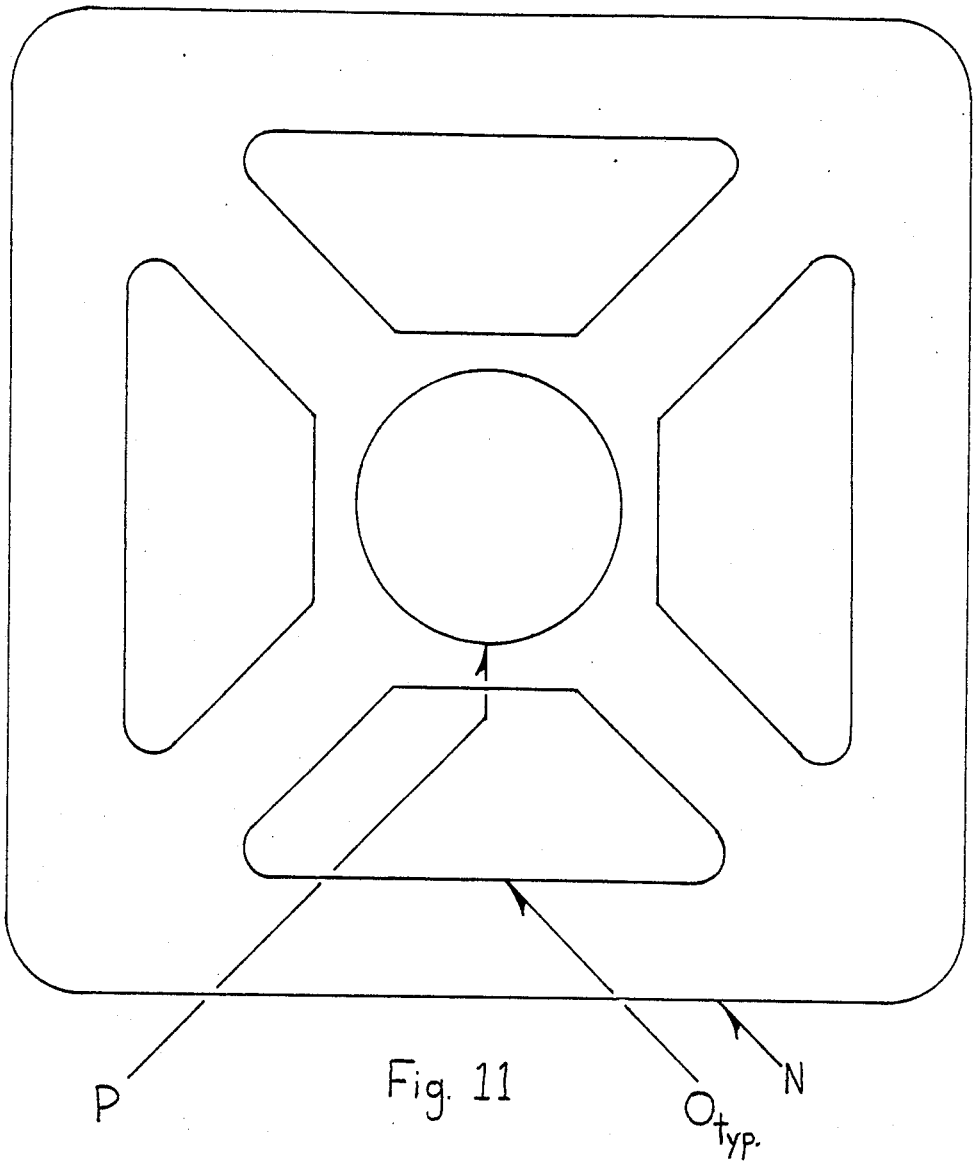
FIG. 11 is the second layer of energy absorbing material and is known as the second layer N.
Figure 12:
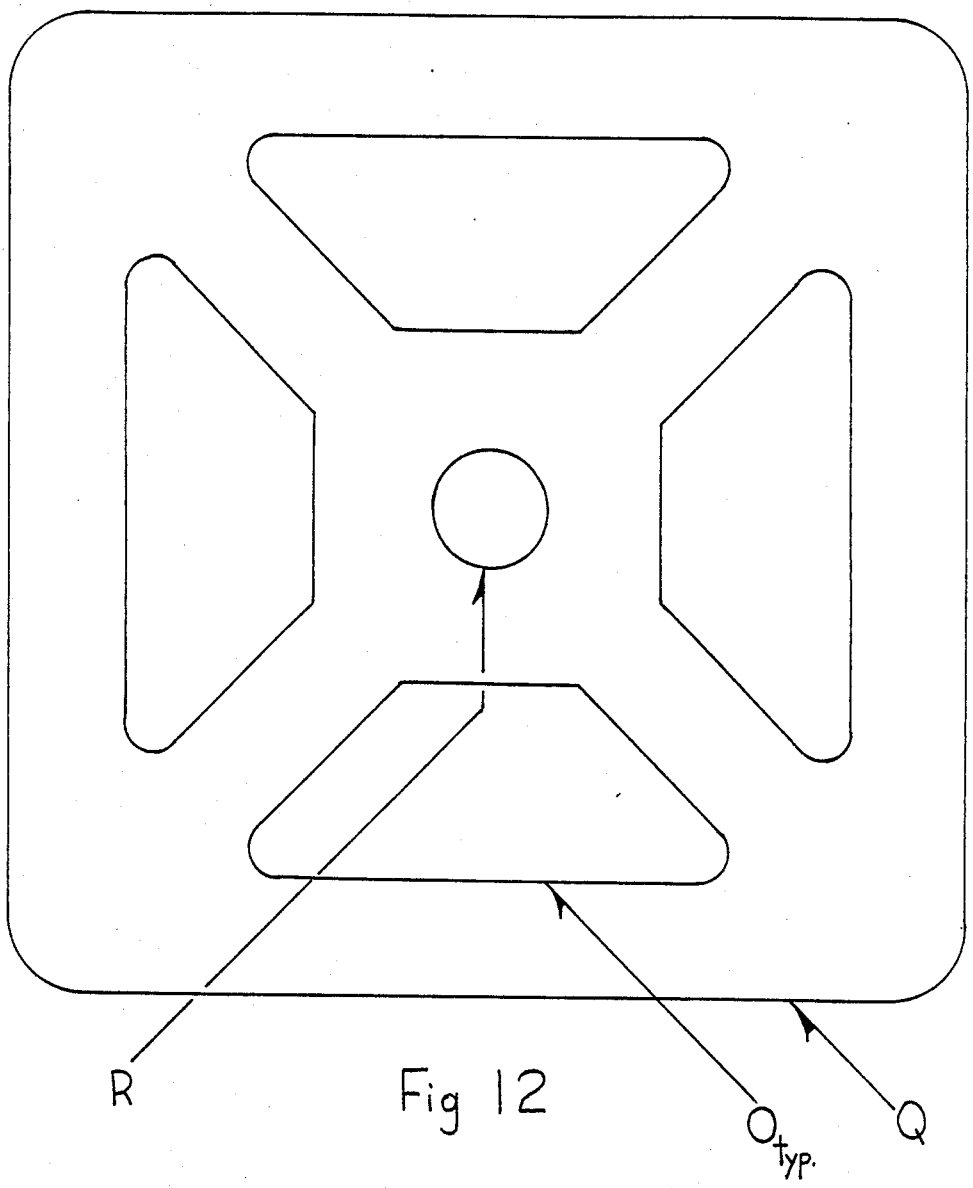
FIG. 12 is the third layer of energy absorbing material, and is known as the third layer Q.
Figure 13:
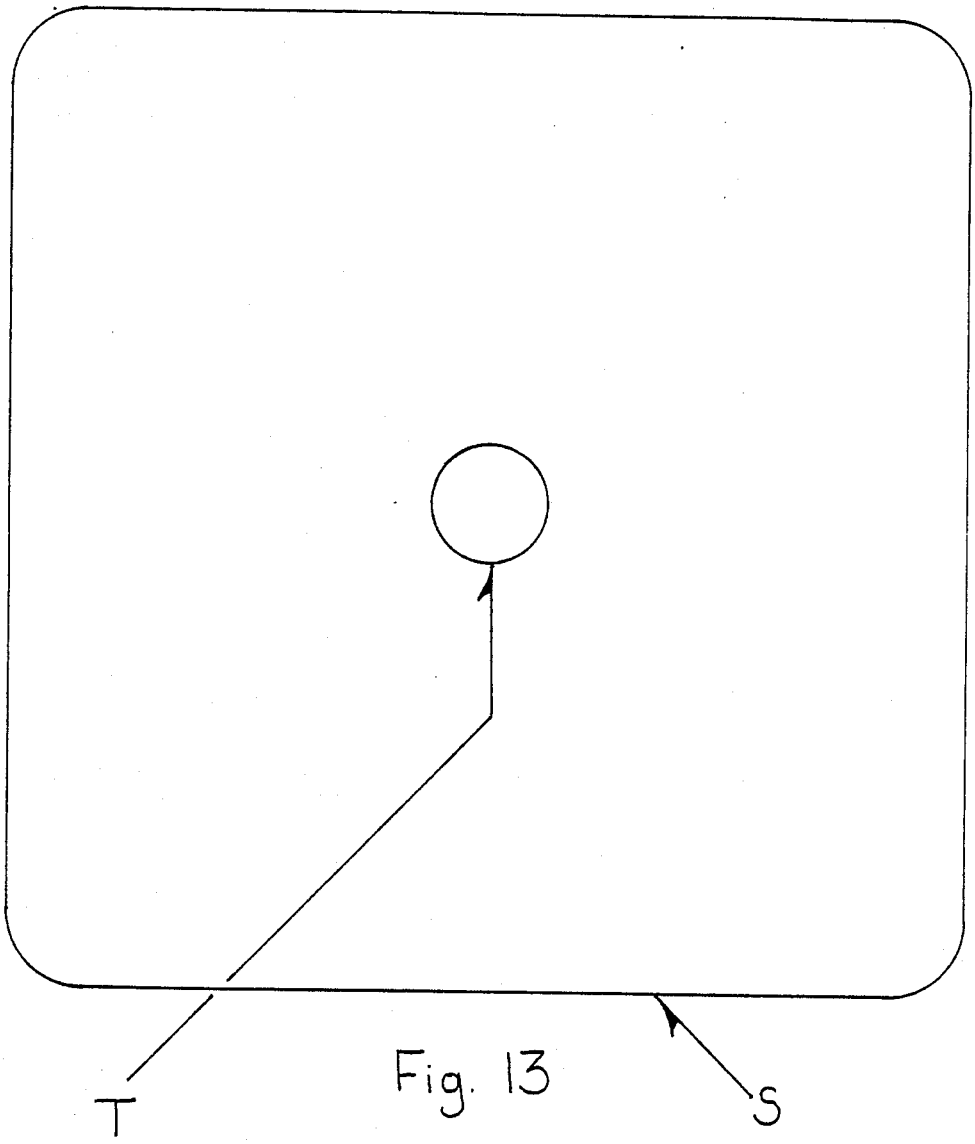
FIG. 13 is the bottom layer of energy absorbing material, and is known as the bottom layer S.
Figure 14:
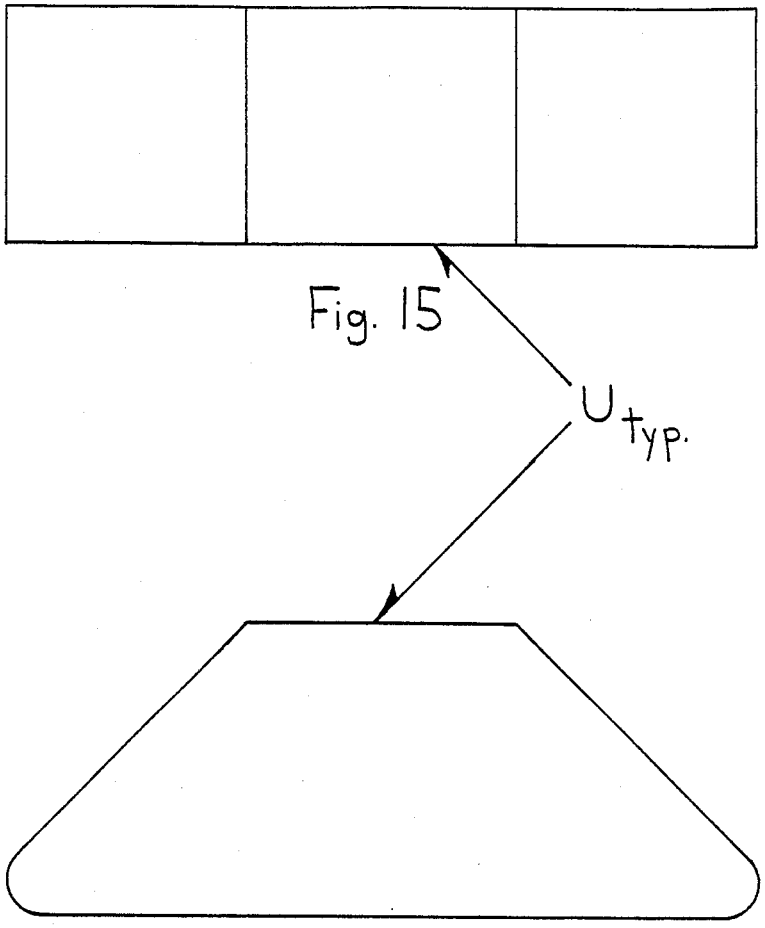
Figure 16:
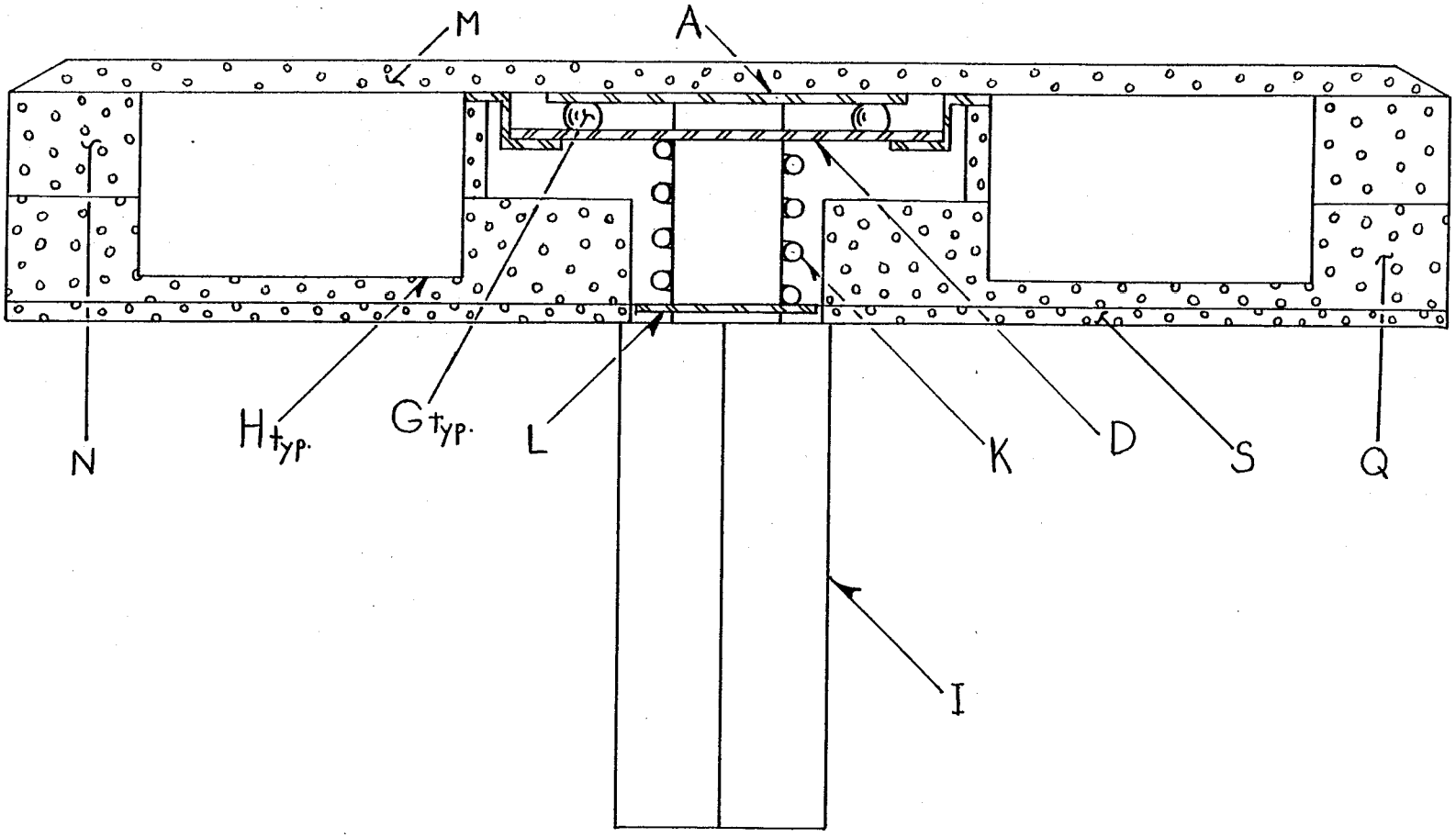
FIG. 16 shows all the component parts of the base except the inserts U. To have included the inserts U would only confuse the drawing.

Now please refer to the drawings. In constructing this safe base the ball locator plate A, the paddle base plate D and the rotate paddle H are made from appropriate size blanks; sheared, formed and drilled as necessary. After the ball locator plate A has been made the center post hole C is drilled then the four locator ball holes B are drilled. The center post I is then welded to the ball locator plate A. The four locator balls G are welded into the four smaller holes B of the ball locator plate A. The center post I and the four locator balls G are all welded to what will be the underside of the ball locator plate A therefore projecting downward in the finished base as shown in FIG. 9. After the paddle base plate D has been made in the same manner as the ball locator plate A a center post hole F is drilled then the four locator ball holes E are drilled. It must be pointed out that the center post holes C and F and the locator ball holes B and E in the respective ball locator plate A and the paddle base plate D must line up exactly as the paddle base plate D freely rotates about the center post I and the welded locator balls G sit in the locator ball holes E in the paddle base plate D to provide correct base alignment when the base is in use on a playing field. Next the four rotate paddles H are welded to the paddle base plate D at the chords between the locator ball holes E. The four rotate paddles H are welded to the underside of the paddle base plate D with the channel sides projecting downward seen as the base would be in use. Now pass the center post I through the center hole of the completed paddle base plate D. The center post I and the channel sides of the paddle base plate D will be projecting in the same direction. The tension spring K is now put on the center post I and the tension spring holder washer L is mounted next. Now the mechanism is put in a jig so designed as to partly compress the tension spring K permitting the tension spring holder washer L to be welded into a pre-calculated position on the center post I. Positioning the tension spring holder washer L thusly provides tension on the underside of the paddle base plate D through the tension spring K which serves to maintain the four locator balls G in the four locator ball holes E in the paddle base plate D providing correct base alignment. This completes assembly of the metal parts. Final assembly begins by adhering the second layer N onto the third layer Q. Next the completed assembly of metal parts is attached to these cemented parts by having the channel sides of the four rotate paddles H grasp the four diagonal arms of the second layer N and the third layer Q as adhered together. Next the topside of the second layer N and the upper surfaces of the four rotate paddles H are coated with adhesive and the top layer M is attached. From underneath the four inserts U are fitted into the four appropriate voids and lastly the bottom layer S is put in place with adhesives to the underside of the third layer Q. Assembly of the base now complete it remains only to enclose the base in a rubberized canvas or nylon cover or as preferred here to completely coat the base itself with a urethane coating. This coating can be brushed, rolled or sprayed on.

What we claim as new is:

1. A yieldable base for securement at selected locations on a playing field, said base comprising:

(a) an anchor post, first and second plates, each plate having a top, bottom and sides;

(b) said first plate having one end of said anchor post attached to and extending vertically from one of its sides at a location generally corresponding to the center thereof, said anchor post being adapted to be fixed at said locations in the field;

(c) said second plate being rotatable and longitudinally movable on said anchor post and spaced from said first plate, by a predetermined distance to define a bearing area therebetween;

(d) bearing means interposed between said plates and being fixed to at least one of said plates, the other of said plates having detent locations for cooperation with said bearing means for moveably retaining said plates in a normal playing position;

(e) biasing means urging said second plate towards said first plate with a predetermined biasing force whereby an impact of a predetermined force at a predetermined location along a side of said base will cause said said second plate to rotate about said anchor post in one rotational direction or the other from said normal playing position to yield in response to said impact and said base being re-alignable in a normal playing position with said bearing means in said detent location; and (f) a resilient pad, said pad being movable relative to said first plate and attached to said second plate for rotation therewith upon application of said predetermined force.

2. The base of claim 1 wherein said pad has a generally square upper and lower surface and wherein said pad is comprised of an energy absorbing material having an exterior covering.

3. The base of claim 2 wherein said energy absorbing material is comprised of multiple layers of expanded cellular foam of varying densities.

4. The base of claim 1 wherein said second plate includes paddle means extending therefrom within said pad.

5. The base of claim 1 wherein said bearing means are symmetrically disposed about the longitudinal axis of said anchor post at 90° intervals with respect to one another.

6. The base of claim 1 further including anchor means adapted to be embedded in said field and adapted to receive said anchor post.

7. A yieldable base for securement at selected locations on a playing field, said base comprising:

an anchor post, first and second plates, each plate having a top, bottom and sides;

(b) a first plate secured to said pad having one of said anchor post attached to and extending vertically from one of its sides at a location generally corresponding to the center thereof, said anchor post being adapted to be fixed at said locations in the field;

(c) said second plate being rotatable and longitudinally movable on said anchor post and spaced apart from said first plate, by a predetermined distance to define a bearing area therebetween;

(d) ball bearing means interposed between said plates in said bearing area and being fixed to said first plate, said second plate having apertures at predetermined locations about said anchor post to define for cooperation with said ball bearing means for yieldably retaining said pad in a normal playing position; and (e) biasing means urging said second plate towards said first plate with a predetermined biasing force whereby an impact of predetermined force at a predetermined location along a side of said base will cause said second plate to rotate in one rotational direction or the other about said anchor post from said normal playing position to yield in response to said impact and said base being re-alignable in a normal playing position with said bearing means in said detent locations; and (f) a resilient pad, said pad being movable relative to said first place and attached to said second plate for rotation therewith upon application of said predetermined force.

* * * * *